US011313088B2

(12) United States Patent
Klein

(10) Patent No.: US 11,313,088 B2
(45) Date of Patent: Apr. 26, 2022

(54) ERECTABLE BARRIER'S BASIC UNIT AND AN ERECTABLE BARRIER COMPRISING THE SAME

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 14 days.

(21) Appl. No.: 16/765,380

(22) PCT Filed: Nov. 20, 2018

(86) PCT No.: PCT/IL2018/051256
§ 371 (c)(1),
(2) Date: May 19, 2020

(87) PCT Pub. No.: WO2019/097526
PCT Pub. Date: May 23, 2019

(65) Prior Publication Data

US 2020/0340194 A1 Oct. 29, 2020

Related U.S. Application Data

(60) Provisional application No. 62/588,438, filed on Nov. 20, 2017.

(51) Int. Cl.
*E01F 13/00* (2006.01)
*E01F 13/12* (2006.01)
*E01F 13/02* (2006.01)

(52) U.S. Cl.
CPC ..... *E01F 13/12* (2013.01); *E01F 13/02* (2013.01)

(58) Field of Classification Search
CPC ..... E01F 13/02; E01F 13/12
USPC ..... 404/6
See application file for complete search history.

(56) References Cited

U.S. PATENT DOCUMENTS 3,630,491 A * 12/1971 Puccio ..... E01F 13/022 256/64
4,762,439 A 8/1988 Carlyle
4,909,483 A * 3/1990 van Herpen ..... E04G 21/3228 256/59
5,356,119 A * 10/1994 Schock ..... E01F 13/022 160/135
5,549,410 A * 8/1996 Beryozkin ..... E01F 13/12 404/6
6,079,904 A * 6/2000 Trisl ..... E02B 3/106 405/107
6,296,234 B1 * 10/2001 De Boer ..... E01F 13/022 256/64

(Continued)

FOREIGN PATENT DOCUMENTS

CN 106468049 A 3/2017
GB 1478840 A 7/1977
WO 2016030886 A1 3/2016

*Primary Examiner* — Raymond W Addie
(74) *Attorney, Agent, or Firm* — William H. Dippert; Laurence A. Greenberg; Werner H. Stemer

(57) ABSTRACT

An erectable barrier's basic unit comprises a base configured to rest on a ground and a movable hurdle pivotally connected to the base and configured to be in a resting position and in an active upright position. The movable hurdle comprises a first movable hurdle portion and a second movable hurdle portion parallel one to the other, and connected by at least one connecting rod. An erectable barrier comprises a plurality of erectable barrier's basic units connected one to the other by at least one connector.

17 Claims, 7 Drawing Sheets

(56) References Cited

U.S. PATENT DOCUMENTS

| | | | | |
|---|---|---|---|---|
| 7,172,176 | B1 * | 2/2007 | Eastland | E01F 13/022 256/26 |
| 7,494,112 | B2 * | 2/2009 | Fromm | E01F 13/12 256/64 |
| 7,918,622 | B2 * | 4/2011 | Whitford | F41H 11/08 404/6 |
| 9,982,403 | B2 * | 5/2018 | Price | E01F 13/02 |
| 10,370,808 | B2 * | 8/2019 | Neusch | E01F 13/02 |
| 10,415,198 | B1 * | 9/2019 | Thomas | E01F 13/02 |
| 10,724,191 | B2 * | 7/2020 | Pan | G05D 1/0011 |
| 2012/0168702 | A1 * | 7/2012 | Fromm | E01F 13/12 256/13.1 |
| 2012/0177439 | A1 * | 7/2012 | More | E01F 13/12 404/6 |
| 2015/0023774 | A1 * | 1/2015 | Seto | E04G 21/3228 414/800 |
| 2017/0204575 | A1 * | 7/2017 | Klein | E01F 15/14 |
| 2018/0258656 | A1 * | 9/2018 | Smith | E04G 21/3228 |
| 2018/0266127 | A1 * | 9/2018 | Smith | E04G 21/3228 |
| 2019/0323187 | A1 * | 10/2019 | Klein | E01F 13/08 |

* cited by examiner

ERECTABLE BARRIER'S BASIC UNIT AND AN ERECTABLE BARRIER COMPRISING THE SAME

CROSS-REFERENCE TO RELATED APPLICATIONS

This patent application is a U.S. National Phase filing under 35 U.S.C. § 371 of PCT Patent Application No. PCT/IL2018/051256, filed Nov. 20, 2018, which is based upon and claims the priority of U.S. Provisional Patent Application Ser. No. 62/588,438, filed Nov. 20, 2017, each of which is incorporated herein by reference in its entirety.

FIELD

The present subject matter relates to road barriers. More particularly, the present subject matter relates to erectable barriers to be erected upon need.

BACKGROUND

Road barriers are used to block roads for the purpose of hostile vehicle mitigation as well as controlling vehicular transportation. Control over roads is a security measure that is essential especially in the last decades. It is a necessity to have better control over roads using erectable barriers that can be deployed upon need.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided an erectable barrier's basic unit (100) comprising:

a base 102 configured to rest on a ground; and a movable hurdle 104 pivotally connected to the base 102 and configured to be in a resting position and in an active upright position, wherein the movable hurdle 104 comprises a first movable hurdle portion 1042 and a second movable hurdle portion 1044 parallel one to the other, and connected by at least one connecting rod 108.

According to one embodiment, in the resting position, the movable hurdle 104 is configured to rest on the base 102.

According to another embodiment, the erectable barrier's basic unit 100 comprises an adjunct 112 provided with pointers 114 configured to transfer energy from an impact of a vehicle with the movable hurdle 104 to the ground.

According to yet another embodiment, the erectable barrier's basic unit 100 comprises a band 116 connected between the base 102 and the movable hurdle 104, and configured to render flexibility between the base 102 and the movable hurdle 104.

According to still another embodiment, the erectable barrier's basic unit 100 comprises an upper connecting element 130 connecting the first movable hurdle portion 1042 with the second movable hurdle portion 1044, and positioned on an upper end of the movable hurdle 104.

According to a further embodiment, the upper connecting element 130 is configured to absorb an impact energy of a vehicle.

According to yet a further embodiment, the erectable barrier's basic unit 100 comprises a front stopping element 150 positioned at a front side of the base 102 and configured to imbed in a bottom of a vehicle attempting to cross the erectable barrier's basic unit 100.

According to still a further embodiment, the erectable barrier's basic unit 100 comprises a frontal wheel 700 attached to the base 102 and configured to facilitate movement of the erectable barrier's basic unit 100.

According to an additional embodiment, the erectable barrier's basic unit 100 comprises a liftable wheel 800 attached to the base 102 and configured to facilitate movement of the erectable barrier's basic unit 100, as well as be in a lifted state when the base 102 is placed directly on the ground, and in a lowered state when the liftable wheel 800 is placed on the ground.

According to another aspect of the present subject matter, there is provided an erectable barrier 300 comprising a plurality of erectable barrier's basic units 100 as described above, the erectable barrier's basic units 100 connected one to the other by at least one connector.

According to one embodiment, the at least one connector is an at least one upper connecting rod 304, or an at least one frontal connecting rod 306, or any combination thereof.

According to another embodiment, the at least one connector is configured to be in an unfolded state when it connects erectable barrier's basic units 100 one to the other, and in a folded state when it does not connect erectable barrier's basic units 100 one to the other.

According to yet another embodiment, the erectable barrier 300 comprises at least one frontal wheel 700 connected to the at least one frontal connecting rod 306, and configured to facilitate movement of the erectable barrier 300.

According to still another embodiment, the erectable barrier 300 comprises at least one liftable wheel 800 attached to a pivot 810 connected to the bases 102 of the erectable barrier's basic units 100, the pivot 810 is configured to be in a lifted state when the bases 102 are placed directly on the ground, and in a lowered state when the at least one liftable wheel 800 is placed on the ground.

According to a further embodiment, the erectable barrier 300 comprises a shaft 820 configured to facilitate shifting of the pivot 810 between the lifted state and the lowered state.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1A:
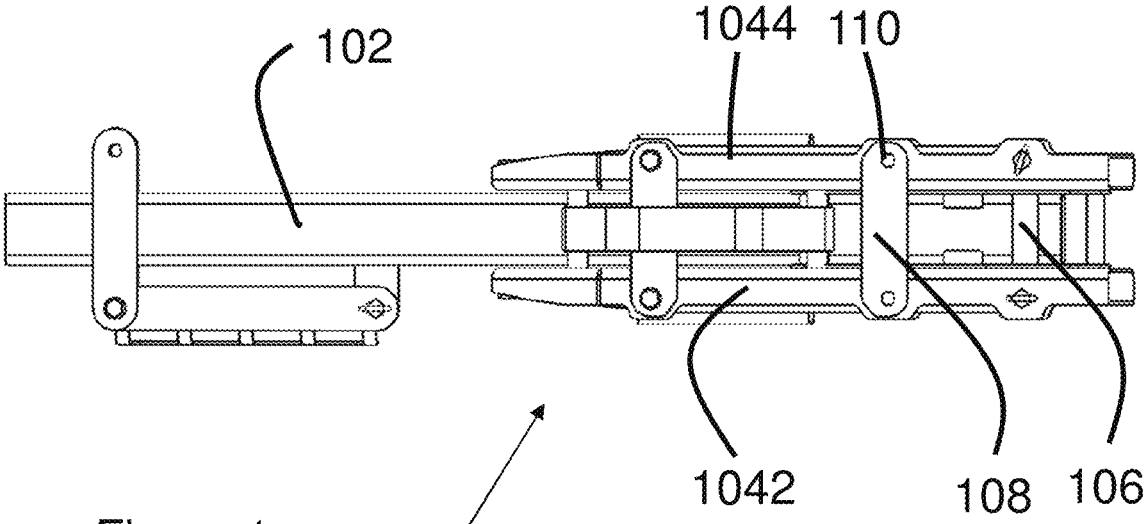
FIGS. 1*a-b* schematically illustrate, according to an exemplary embodiment, a top view and a side view, respectively, of a basic unit of an erectable barrier in a resting position.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

Figure 1B:
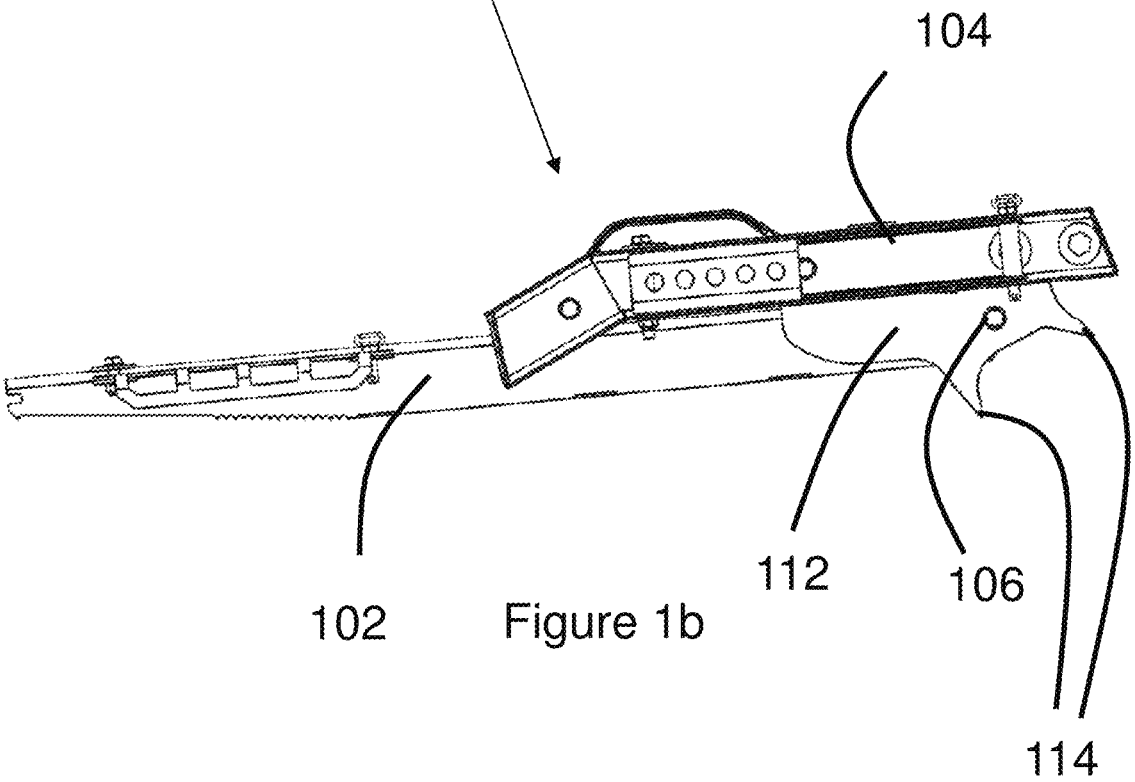

FIGS. 1*a-b* schematically illustrate, according to an exemplary embodiment, a top view and a side view, respectively, of a basic unit of an erectable barrier in a resting position. The erectable barrier's basic unit 100 comprises two segments—a lower segment that forms a base 102 that is configured to rest on the ground and an upper segment that is a movable hurdle 104 that is pivotally connected to the base 102. According to one embodiment, the movable hurdle 104 is connected to the base 102 through a hinge 106 (better seen in FIG. 1*b*). According to one embodiment, the movable hurdle 104 is configured to be in a resting position, shown in FIGS. 1*a-b*, and in an active upright position, shown in FIGS. 2*a-b* hereinafter. In the resting position, the movable hurdle 104 is configured to rest on the base 102. According to a further embodiment, the movable hurdle 102 is configured to rotate about the hinge 106 and be positioned in an active upright position. According to yet a further embodiment, in the active upright position, the movable hurdle 104 is in a substantially vertical position (will be shown hereinafter). The movable hurdle 104 comprises two parallel and substantially similar portions—a first movable hurdle portion 1042 and a second movable hurdle portion 1044 parallel one to the other, so that when the basic unit 100 is in a resting position, the hurdle 104 is mounted on the base 102 so that the first movable hurdle portion 1042 and the second movable hurdle portion 1044 are placed on both sides of the base 102, as can be clearly seen in FIG. 1*a*. The first movable hurdle portion 1042 is connected to the second movable hurdle portion 1044 by at least one connecting rod 108 that can be connected between the first movable hurdle portion 1042 and the second movable hurdle portion 1044 by using any connecting element known in the art, for example at least one screw 110 as illustrated in FIG. 1*a*, welding, at least one pin, or any other suitable means for connecting elements made of a rigid material, like metal.

As can be seen in FIG. 1*b*, at the area of connection of the movable hurdle 104 with the base 102, for example at the area of the hinge 106, an adjunct 112 is provided. The adjunct 112 is provided on both sides of the movable hurdle 104 and is attached to the hinge 106 in a manner that allows the movable hurdle 104 to rotate about the base 102. The adjunct 112 is the portion of the hinge 106 area that is in contact with the ground. The adjunct 112, namely the hinge area, is provided with pointers 114 that are configured to transfer energy from an impact of a vehicle with the movable hurdle 104 to the ground.

Figure 2A:
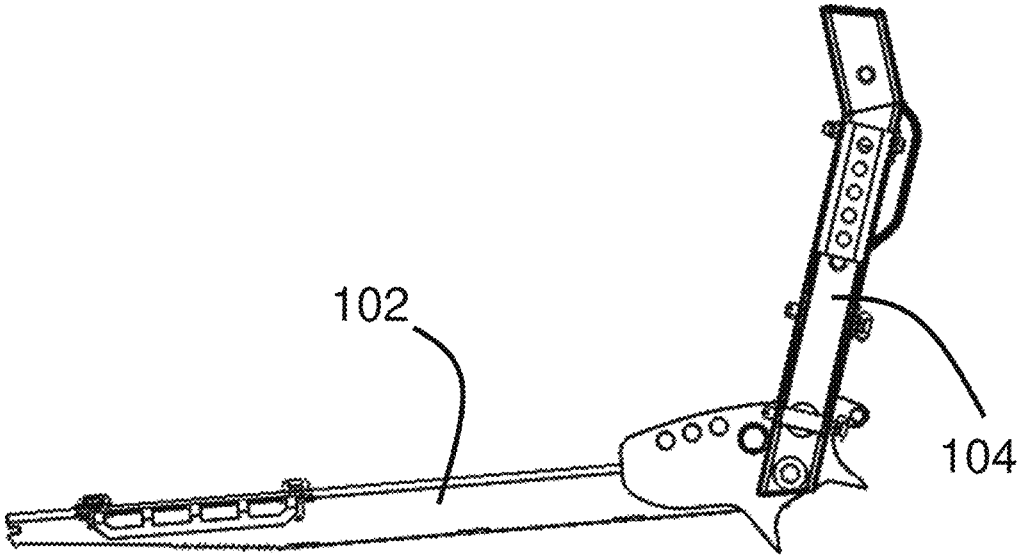
FIGS. 2*a-b* schematically illustrate a side view of some exemplary embodiments of a basic unit of an erectable barrier, in an active upright position.
Figure 2B:
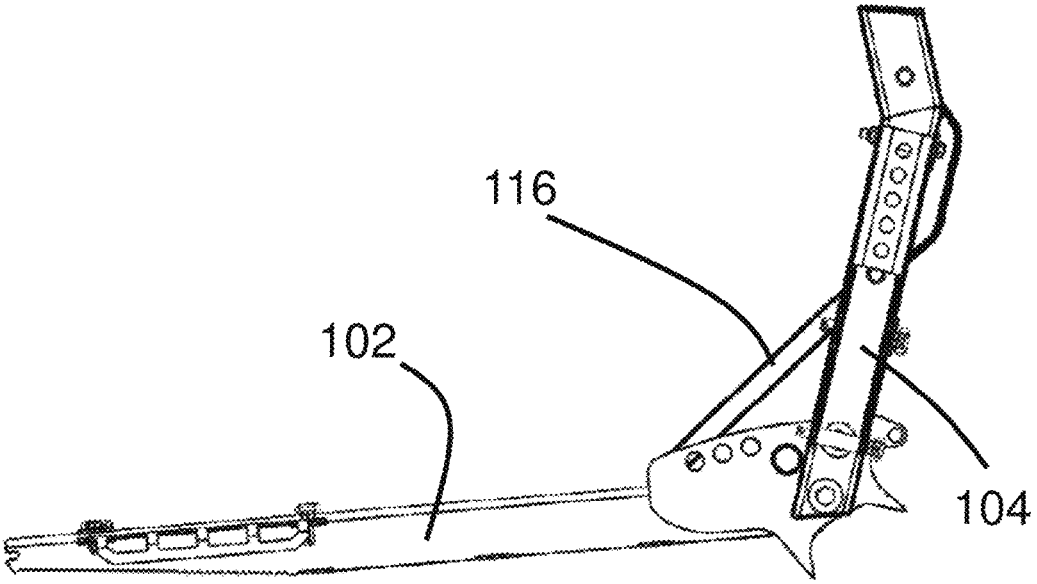

FIGS. 2*a-b* schematically illustrate a side view of some exemplary embodiments of a basic unit of an erectable barrier, in an active upright position. FIG. 2*a* illustrates an embodiment as shown in FIGS. 1*a* and 1*b*, while in FIG. 2*b* a band 116 is provided to further strengthen the barrier in case an impact from a vehicle occurs. Embodiments of the band 116 are described hereinafter.

The movable hurdle 104, when in an upright active position, is arranged to be limited to an angle of slightly more than substantially 90° between the movable hurdle 104 and the base 102. Preferably the angle between the movable hurdle 104 and the base 102 is in the range of substantially 110±10°. However, the barrier can operate also in angles between the movable hurdle 104 and the base 102 in the range of substantially 60-90°.

Optionally but preferably, the band 116 shown in FIG. 2*b* is provided between the two parts of the barrier—the base 102 and the movable hurdle 104. The band 116 is connected between the base 102 and the movable hurdle 104. According to one embodiment, the band 116 is configured to avoid impact of a sudden release of the movable hurdle 104 from the base 102 upon opening the basic unit 100, or a barrier comprising basic units 100. to an active upright state and to render some flexibility between the base 102 and the movable hurdle 104.

According to one embodiment, the erectable barrier comprises at least one basic unit 100. According to a preferred embodiment, the erectable barrier comprises a plurality of basic units. According to yet another embodiment, the erectable barrier is configured to be placed on a road and be left on site for a predetermined period of time as needed. Then, the barrier can be transferred to another site. One of the advantages of building the barrier from an at least one basic unit 100, or a plurality of basic units 100, is that the basic units 100 are independent one from the other and therefore some of the basic units 100 may be placed in an upright active position while other basic units 100 may be in a resting position, as desired. The basic units 100 are provided with connectors configured to connect one basic unit 100 to another basic unit 100 in order to build a barrier as described hereinafter.

Figure 3A:
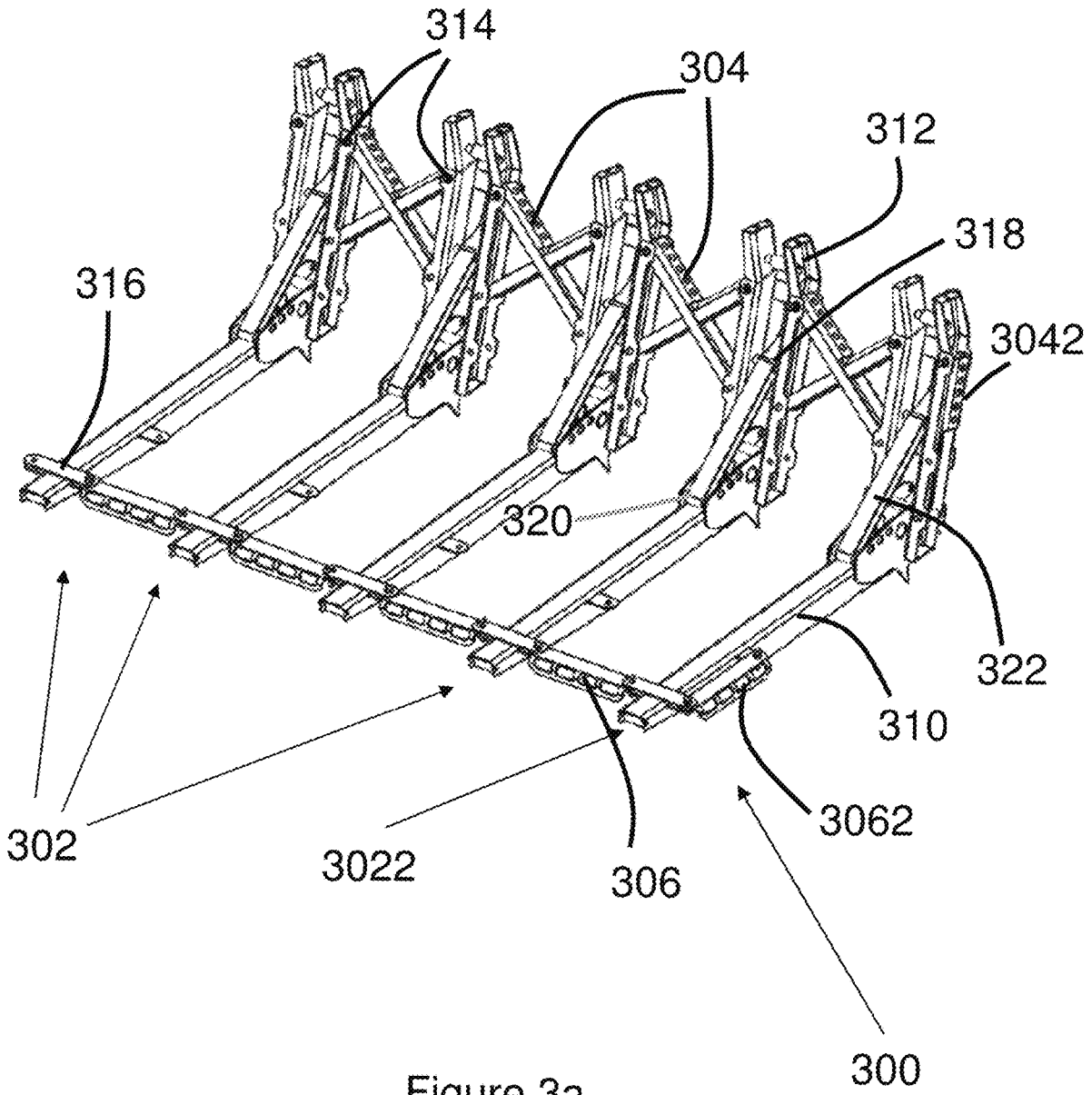
FIGS. 3*a-c* schematically illustrate, according to an exemplary embodiment, an upper perspective view, an upper view and a back view, respectively, of an erectable barrier in an active upright position.
Figure 3B:
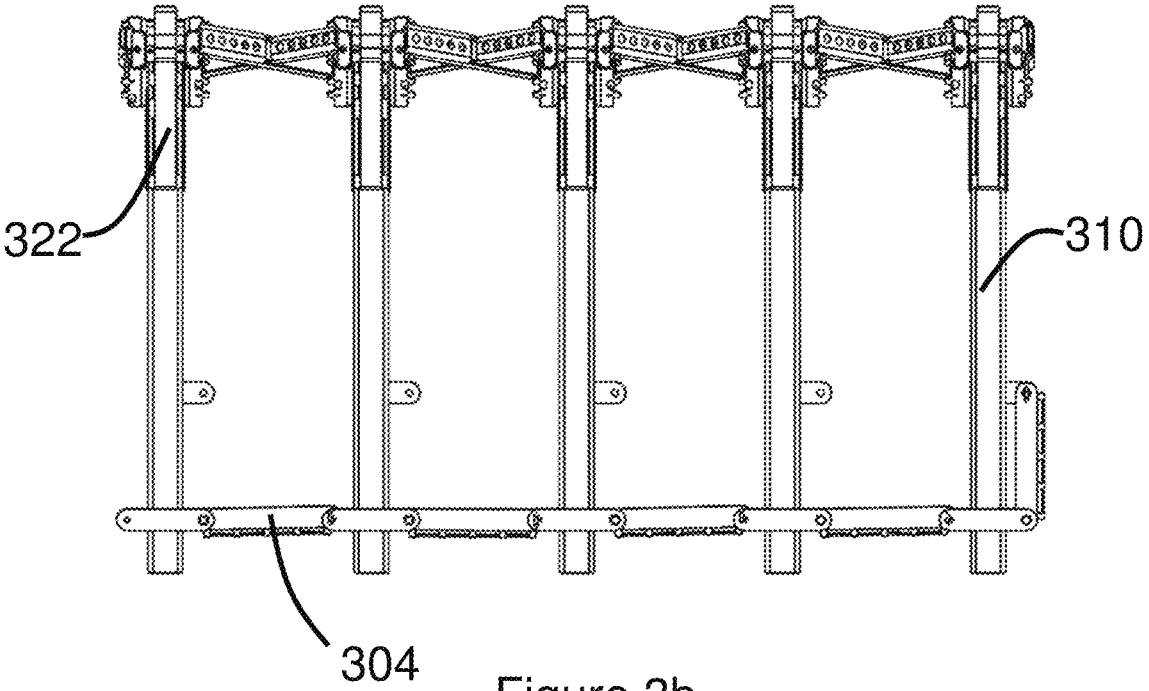
Figure 3C:
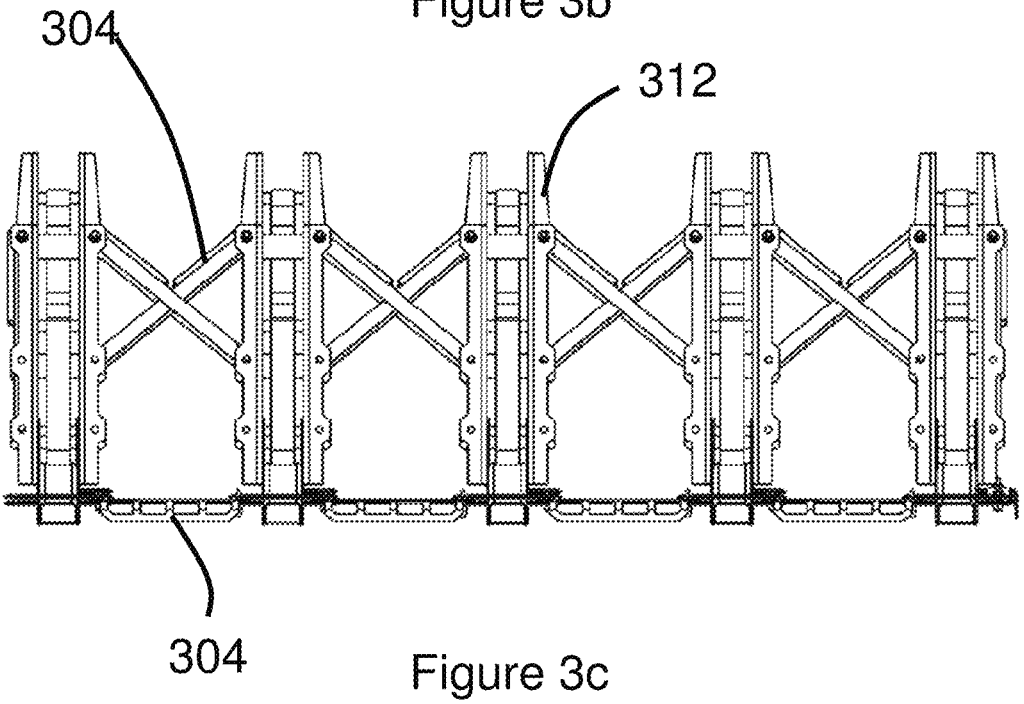

FIGS. 3*a-c* schematically illustrate, according to an exemplary embodiment, an upper perspective view, an upper view and a back view, respectively, of an erectable barrier in an active upright position. The erectable barrier 300 is made of at least on barrier unit 302, preferably a plurality of barrier units 302 similar to basic units 100 shown in FIGS. 1*a-b*. The barrier units 100 are connected one to the other by an at least one connector. The barrier units 302 in the embodiment illustrated in FIGS. 3*a-c* are connected one to the other by at least one of upper connecting rod 304, and an at least one of frontal connecting rod 306. In other words, the at least one connector may be at least one upper connecting rod 304, or at least one frontal connecting rod 306, or a combination thereof. According to one embodiment, the at least one connector, namely the upper connecting rod 304 and the frontal connecting rod 306, is configured to be in an unfolded state when it connects basic units 100 one to the other, or in a folded state when it does not connect basic units 100 one to the other. In FIG. 3*a*, the upper connecting rods 304 and the frontal connecting rods 306 are shown to be unfolded and connecting the barrier units 302. However, the upper connecting rod 3042 and the frontal connecting rod 3062 that are connected to the barrier unit 3022 that is at the right edge of the barrier 300 shown in FIG. 3*a* are folded since this barrier unit 3022 is not connected to an adjacent barrier unit 302 at the right hand-side of the barrier 300. It should be noted that the arrangement of connecting the barrier units 302 illustrated in FIG. 3*a* is only exemplary, and should not be considered as limiting the scope of the present subject matter. Any other arrangement of the barrier units 302 is under the scope of the present subject matter.

Similarly to the embodiment illustrated for example in FIG. 1*a*, each barrier unit 302 comprises two segments—a base 310 and a movable hurdle 312. The upper connecting rods 304 and the frontal connecting rods 306 are attached to the movable hurdle 312 or to the base 310 by using attaching elements, for example screws 314 shown in FIG. 3*a* connecting the upper connecting rods 304 to the movable hurdles 312, flanges 316 shown in FIG. 3*a* connecting the frontal connecting rods 306 to the bases 310, and the like.

Optionally, as illustrated in FIG. 3*a*, two flanges 318 and 320, are provided, one connected to the hurdle 312 and the other on the base 310, respectively, where a band 322 is incorporated and is held between the base 310 and the hurdle 312. According to one embodiment, the band 322 is rigid. According to another embodiment, the band 322 is flexible.

Figure 4A:
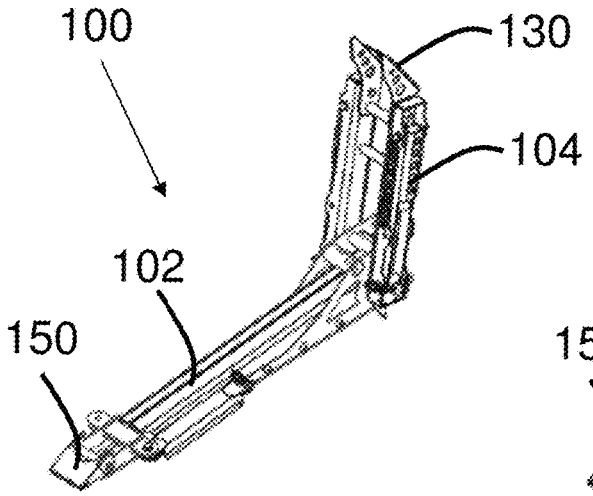
FIGS. 4*a-b* schematically illustrate, according to some additional embodiments, a front perspective view of a basic unit, in an active upright position and in a resting position, respectively.
Figure 4B:
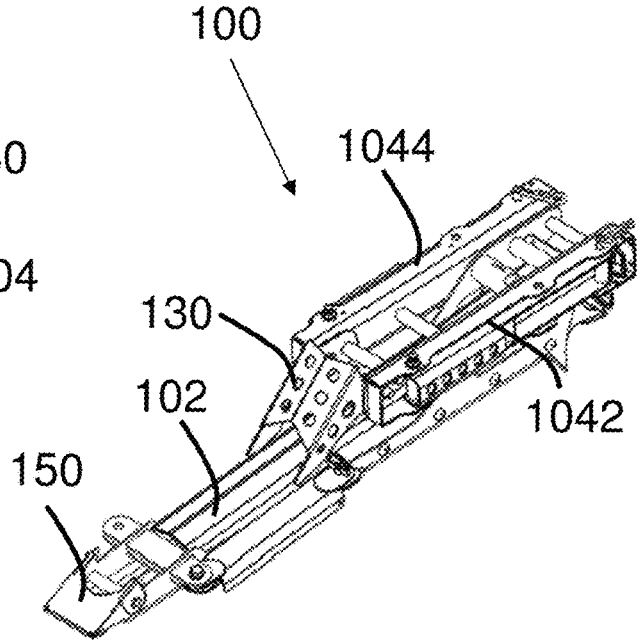

FIGS. 4*a-b* schematically illustrate, according to some additional embodiments, a front perspective view of a basic unit, in an active upright position and in a resting position, respectively. According to the embodiment illustrated for example in FIG. 1*a*, the first movable hurdle portion 1042 is connected to the second movable hurdle portion 1044 by using at least one connecting rod 108. In the embodiment illustrated in FIGS. 4*a-b*, the first movable hurdle portion 1042 may be connected to the second movable hurdle portion 1044 with an upper connecting element 130 positioned on an upper end of the movable hurdle 104. In addition, the upper connecting element 130 is configured to absorb an impact energy of a vehicle attempting to cross a barrier comprising at least one basic unit 100, thus contributing to the function of the barrier—blocking further movement of the vehicle.

Furthermore, the basic unit 100 may comprise a front stopping element 150 positioned at a front side of the base 102, distally to the side of the base 102 that is connected to the movable hurdle 104. According to one embodiment, the front stopping element 150 is configured to imbed in a bottom of a vehicle attempting to cross the basic unit 100, or a barrier comprising at least one basic unit 100. When a vehicle attempts to cross the basic unit 100, a front of the vehicle impacts the upright positioned movable hurdle 104. This causes the movable hurdle 104 to move downwards and in parallel it causes the base 102 to move upwards, giving rise to the front stopping element 150 to imbed in the bottom of the vehicle and contributed to the blocking of further movement of the vehicle.

Figure 5:
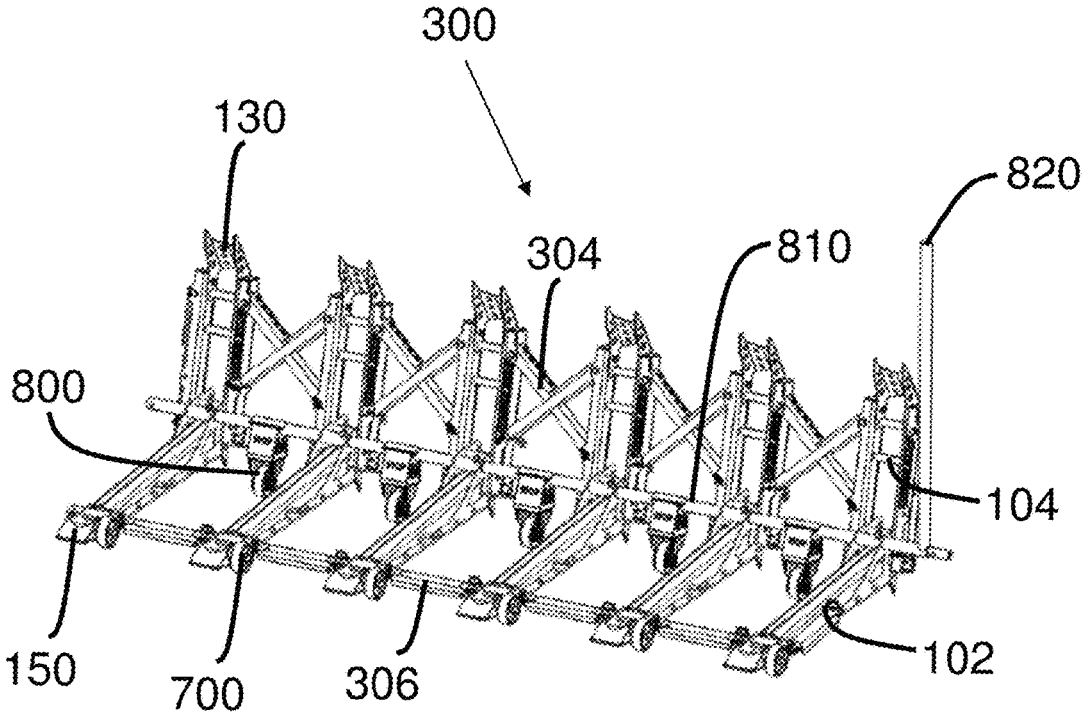
FIG. 5 schematically illustrates, according to some additional exemplary embodiments, a front perspective view of an erectable barrier.

FIG. 5 schematically illustrates, according to some additional exemplary embodiments, a front perspective view of an erectable barrier. The erectable barrier 302 is essentially similar to the erectable barrier 302 illustrated for example in FIG. 3*a*, except that the basic units 100, of which the erectable barrier 302 is comprised, are similar to the basic unit 100 illustrated in FIGS. 4*a-b*. In other words, the basic units 100 illustrated in FIG. 5 comprise each an upper connecting element 130 and a front stopping element 150.

In additional, the erectable barrier 300 may comprise at least one front wheel 700, configured to facilitate movement of the erectable barrier 302. According to another embodiment, the basic unit 100 comprises a frontal wheel 700 configured to facilitate movement of the basic unit 100. According to one embodiment, the at least one wheel 700 is attached to a base 102 of a basic unit 100. According to another embodiment, the at least one wheel 700 is attached to a front side of the base 102, for example adjacent to the front stopping element 150. According to a preferred embodiment, each basic unit 100 of the erectable barrier 302 comprises a wheel 700 attached to a front side of the base 102, adjacent to the front stopping element 150, as illustrated in FIG. 5. According to a further embodiment, at least one frontal wheel 700 may be attached to the frontal connecting rod 306 of the erectable barrier 300.

According to one embodiment, the erectable barrier 302 may comprise at least one liftable wheel 800, configured to facilitate movement of the erectable barrier 302, as well as being in two states: lifted state and lowered state. According to one embodiment, the at least one liftable wheel 800 is attached to the base 102 of the basic unit 100 and configured to facilitate movement or the basic unit 100. According to another embodiment, the at least one liftable wheel 800 is attached to a pivot 810 that may be connected to the basic units 100 of an erectable barrier 302. According to yet another embodiment, the pivot 810 is attached to the bases 102 of the basic units 100 at any position along the base 102. According to a preferred embodiment, the pivot 810 is attached to the bases 102 in a position adjacent to the connection points of the bases 102 with the movable hurdles 104, as illustrated in FIG. 5.

In the lifted state, the at least one liftable wheel 800 is lifted and the bases 102 are placed directly on the ground. For example, when the barrier 302 is in designated to block movement of vehicles, the at least one liftable wheel 800 is in a lifted state and the bases 102 of the placed directly on the ground. However, when there is a need to move the erectable barrier 302 from its placed, the at least one liftable wheel is transitioned to the lowered state. At the lowered state the at least one liftable wheel 800 is placed on the ground, thus lifting the bases 102 above the ground, and allowing movement of the erectable barrier 302 on the ground with the aid of the at least one liftable wheel 800. Therefore, an erectable barrier 302 comprising at least one liftable wheel 800 may be configured to serve as a gate, that may be moved when the at least one liftable wheel 800 is in the lifted state, for example aside a road, in order to allow movement of cars on the road; while when it is desired to block the road the erectable barrier 302 is returned to the road and the at least one liftable wheel 800 is shifted to the lowered state.

According to one embodiment, the liftable wheels 800 are attached to a pivot 810, and the pivot 810 is configured to be in a lifted state or a lowered state, thus shifting the at least on liftable wheel 800 between these two positions. According to another embodiment, the erectable barrier further comprises a shaft 820 configured to facilitate the shifting of the pivot 810 between the lifted state and the lowered state. for example, moving the shaft 820 to one side brings the pivot 810 to a lifted state, while moving the shaft 820 to another side brings the pivot 810 to a lowered state. According to one embodiment, the shaft 820 may be attached to the pivot 810.

Figure 6:
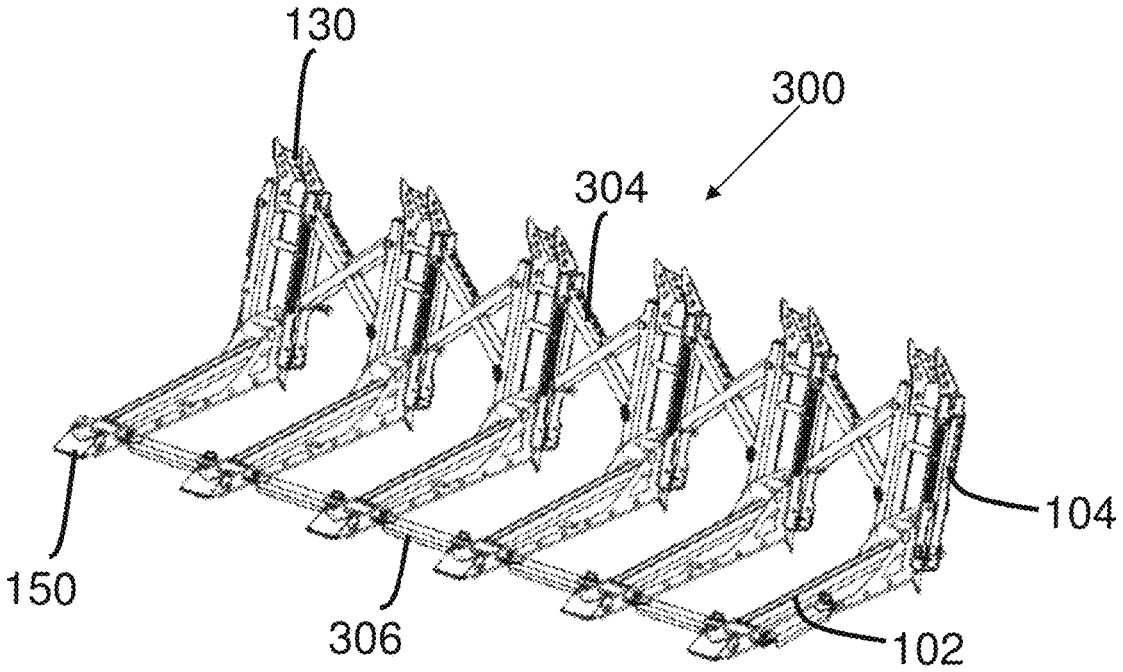
FIG. 6 schematically illustrates, according to some further exemplary embodiments, a front perspective view of an erectable barrier.

FIG. 6 schematically illustrates, according to some further exemplary embodiments, a front perspective view of an erectable barrier. The erectable barrier 302 illustrated in FIG. 6 is essentially similar to the erectable barrier 302 illustrated in FIG. 5 except that it does not comprise the at least one wheel 700 and the at least one liftable wheel 800, pivot 810 and shaft 820.

Figure 7A:
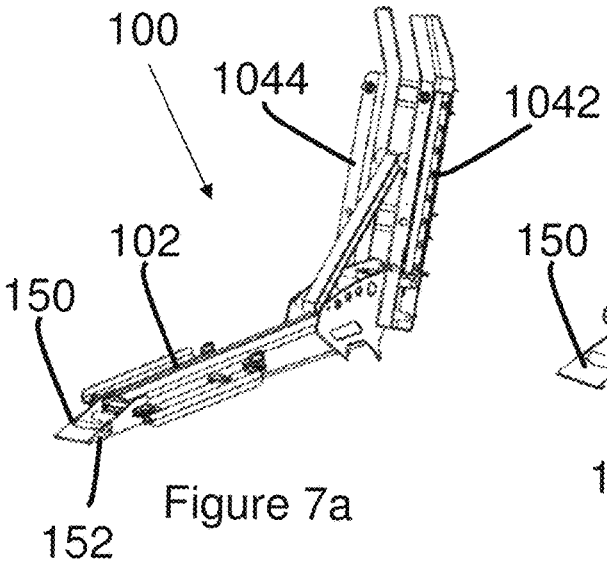
FIGS. 7*a-b* schematically illustrate a front perspective view of an additional exemplary embodiments of a basic unit of an erectable barrier, in an active upright position and a resting position, respectively.
Figure 7B:
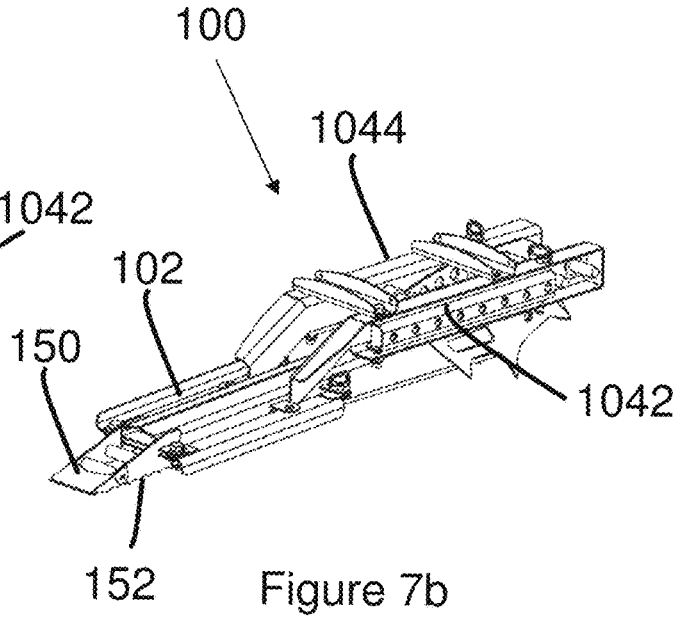

FIGS. 7*a-b* schematically illustrate a front perspective view of an additional exemplary embodiments of a basic unit of an erectable barrier, in an active upright position and a resting position, respectively. According to one embodiment, the base 102 of the basic unit 100 may comprise friction element 152 that are configured to increase the friction between the base 102 and the ground on which the base 102 stands, in order to enhance the ability of a barrier 302 comprising such basic units 100 to block a moving vehicle. The friction elements 152 may have any shape known in the art that increases friction with the ground, for example the friction elements 152 may have a shape of teeth extending from the base 102 towards the ground. According to the embodiment illustrated in FIGS. 7*a-b*, friction elements 152 are positioned on the front stopping element 150.

Figure 8:
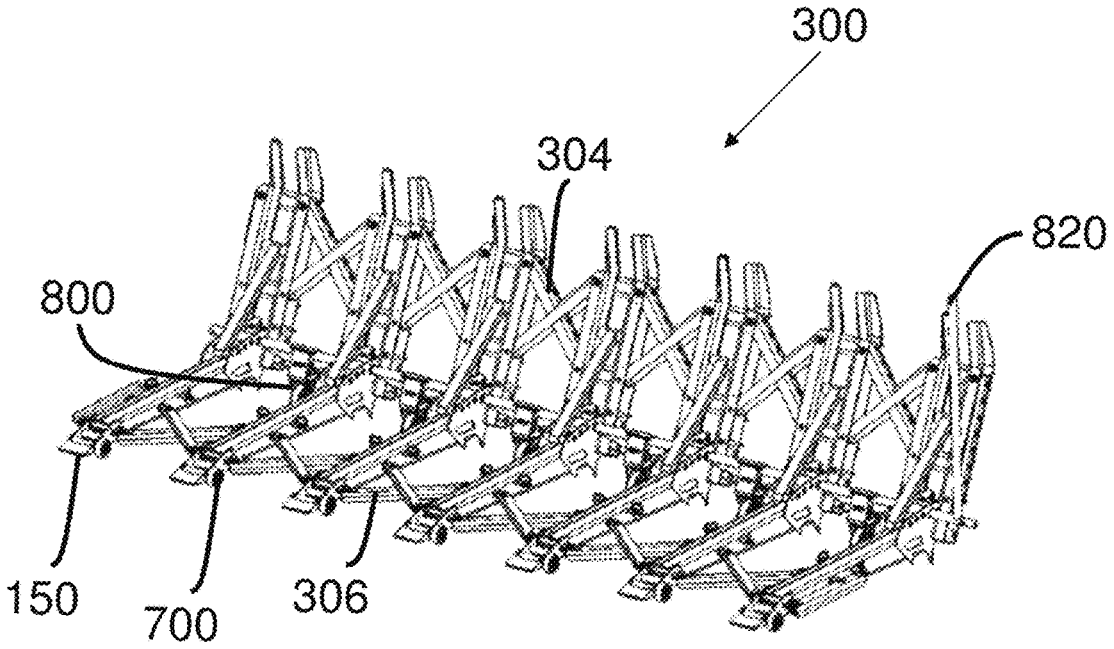
FIG. 8 schematically illustrates a front perspective view of a further exemplary embodiment of an erectable barrier.

FIG. 8 schematically illustrates a front perspective view of a further exemplary embodiment of an erectable barrier. The erectable barrier illustrated in FIG. 8 is similar to the erectable barrier 300 illustrated in FIG. 5 except that the erectable barrier 300 illustrated in FIG. 5 comprises a linear frontal connecting rod 306 between each two basic units 100, while the erectable barrier 300 illustrated in FIG. 8 comprises two frontal connecting rods 306 forming a shape of an X between each two basic units 100. Experiments showed that an erectable barrier 300 comprising two frontal connecting rods 306 forming a shape of an X between each two basic units 100 is more stable and more durable in stopping moving cars that an erectable barrier 300 comprising a linear frontal connecting rod 306 between each two basic units 100.

Figure 9:
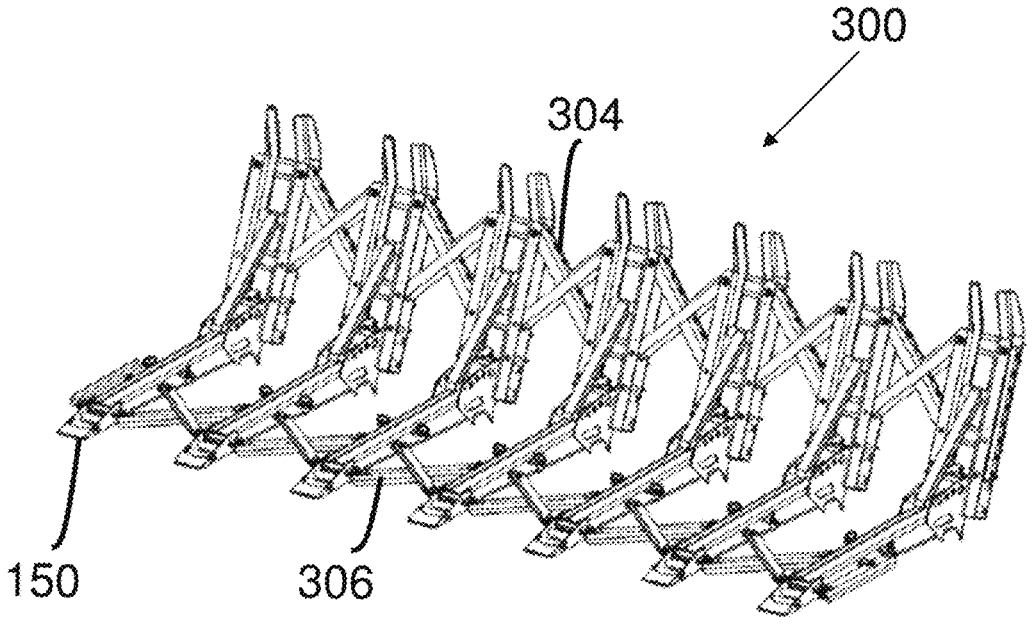
FIG. 9 schematically illustrates, according to some additional exemplary embodiments, a front perspective view of an erectable barrier.

FIG. 9 schematically illustrates, according to some additional exemplary embodiments, a front perspective view of an erectable barrier. The erectable barrier 302 illustrated in FIG. 9 is essentially similar to the erectable barrier 302 illustrated in FIG. 8 except that it does not comprise the at least one wheel 700 and the at least one liftable wheel 800, pivot 810 and shaft 820.

It should be noted that the erectable barrier 300 of the present subject matter may have any size known in the art, thus configured to absorb any energy level of moving vehicles known in the art, from private cars to trucks. For example, the erectable barrier 300 illustrated in FIGS. 3*a-c* is smaller than the erectable barrier 300 illustrated in FIGS. 5, 6, 8 and 9. In experiments conducted by the inventor it was found that the erectable barrier 300 illustrated in FIGS. 5, 6, 8 and 9 is capable of absorbing an energy level of substantially 670 kilojoules (KJ), or more particularly an energy level of substantially 667 KJ, which is typical to a truck attempting to cross the erectable barrier 300.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A basic unit for an erectable barrier comprising:

a base configured to rest on a ground; and a movable hurdle pivotally connected to opposite sides of the base and configured to be in a resting position and in an active upright position, wherein the movable hurdle comprises a first distinct movable hurdle portion and a second distinct movable hurdle portion parallel one to the other, and connected by at least one connecting rod and wherein in the resting position, the movable hurdle substantially rests on the base wherein the first distinct movable hurdle portion and the second distinct movable hurdle portion are outwardly placed on opposite sides of the base.

2. The basic unit of claim 1, further comprising a band connected between the base and the movable hurdle.

3. The basic unit of claim 1, further comprising a front stopping element positioned at a front side of the base and being configured to be imbedded in a bottom of a vehicle attempting to cross the basic unit of the erectable barrier.

4. The basic unit of claim 1, further comprising a frontal wheel attached to the base and configured to facilitate movement of the basic unit.

5. The basic unit of claim 1, further comprising a liftable wheel attached to the base and configured to facilitate movement of the basic unit, as well as to be in a lifted state when the base is placed directly on the ground, and in a lowered state when the liftable wheel is placed on the ground.

6. The basic unit of claim 1, wherein the movable hurdle is pivotally connected to the base by a hinge.

7. The basic unit of claim 6, comprising an adjunct in an area of the hinge and wherein said adjunct is provided with pointers configured to be in contact with the ground.

8. The basic unit of claim 7, wherein the adjunct is provided on both sides of the area of the hinge of the movable hurdle.

9. The basic unit of claim 7, wherein the pointers are directed towards the ground so as to transfer energy from an impact of a vehicle with the movable hurdle to the ground.

10. The basic unit of claim 1, further comprising an upper connecting element connecting the first movable hurdle portion with the second movable hurdle portion, and wherein the upper connecting element is positioned on an upper end of the movable hurdle.

11. The basic unit of claim 10, wherein the upper connecting element is configured to absorb an impact energy of a vehicle.

12. An erectable barrier comprising a plurality of basic units as claimed in claim 1, the basic units being connected one to the other by at least one connector.

13. The erectable barrier of claim 12, wherein the at least one connector is configured to be in an unfolded state when it connects the basic units one to the other, and in a folded state when it does not connect the basic units one to the other.

14. The erectable barrier of claim 12, wherein the at least one connector is an at least one upper connecting rod, or an at least one frontal connecting rod, or any combination thereof.

15. The erectable barrier of claim 14, further comprising at least one frontal wheel connected to at least one frontal connecting rod, wherein the at least one frontal wheel is configured to facilitate movement of the erectable barrier.

16. The erectable barrier of claim 12, further comprising at least one liftable wheel attached to a pivot connected to the bases of the basic units, wherein the pivot is configured to be in a lifted state when the bases are placed directly on the ground, and in a lowered state when the at least one liftable wheel is placed on the ground.

17. The erectable barrier of claim 16, further comprising a shaft configured to facilitate shifting of the pivot between the lifted state and the lowered state.

* * * * *